United States Patent [19]

Braaten

[11] Patent Number: 4,670,228

[45] Date of Patent: Jun. 2, 1987

[54] PROCESS FOR THE RECOVERY OF VALUABLE METALS, PARTICULARLY RARE EARTHS AND SIMILAR METALS, FROM A CARBONATE-CONTAINING RAW MATERIAL

[75] Inventor: Orvar Braaten, Oslo, Norway

[73] Assignee: A/S Megon & Co., Oslo, Norway

[21] Appl. No.: 731,624

[22] PCT Filed: Sep. 20, 1984

[86] PCT No.: PCT/NO84/00037

§ 371 Date: Apr. 16, 1985

§ 102(e) Date: Apr. 16, 1985

[87] PCT Pub. No.: WO85/01300

PCT Pub. Date: Mar. 28, 1985

[30] Foreign Application Priority Data

Sep. 21, 1983 [NO] Norway ..... 833394

[51] Int. Cl.[4] ..... C01F 17/00

[52] U.S. Cl. ..... 423/21.1; 423/166; 423/175; 423/263; 423/431

[58] Field of Search ..... 423/21.1, 166, 263, 423/431, 438, 175

[56] References Cited

U.S. PATENT DOCUMENTS

| | | | |
|---|---|---|---|
| 2,900,231 | 8/1959 | Kremers et al. | 423/21.1 |
| 3,025,131 | 3/1962 | Lerner | 423/21.1 |
| 3,722,867 | 3/1973 | Butler | 423/175 |
| 4,220,631 | 9/1980 | Serbent et al. | 423/175 |
| 4,464,344 | 8/1984 | Saikkonen | 423/21.1 |

*Primary Examiner*—Andrew H. Metz
*Assistant Examiner*—Anthony McFarlane
*Attorney, Agent, or Firm*—Wenderoth, Lind & Ponack

[57] ABSTRACT

Process for the recovery of valuable metals, particularly rare earths and similar metals, which occur in a finely distributed condition in a raw material containing calcium carbonate.

The raw material with the valuable elements is subjected to vigorous heating to decompose calcium carbonate and is allowed to react with sulphur oxides, particularly $SO_2$, so that the calcium present is converted to insoluble calcium sulphate. The valuable metals are extracted from the calcine by extraction with dilute acid or water, whereafter the valuable metals are recovered from the extract in a per se known manner.

The heating and the reaction with sulphur oxides may be carried out by mixing the raw material containing the valuable elements with sulphur or a combustible sulphurous material, such as pyrite, and subjecting it to exothermic combustion.

3 Claims, 3 Drawing Figures

PROCESS FOR THE RECOVERY OF VALUABLE METALS, PARTICULARLY RARE EARTHS AND SIMILAR METALS, FROM A CARBONATE-CONTAINING RAW MATERIAL

In nature there are several examples of the occurence of valuable metals in large or small amounts under such conditions that their recovery in an economical manner is difficult or practically impossible. An example of such conditions is the presence of valuable metals in finely divided form in a matrix which contains considerable amounts of calcium carbonate, i.e. so-called carbonatites. Due to the finely divided form the valuable metals cannot be recovered by ordinary ore dressing, such as flotation. Efforts to recover by extraction with acid will normally lead to an unacceptably high acid consumption since a considerable part of the acid employed is consumed for the neutralisation of calcium carbonate.

Valuable metals which are of particular interest and which are connected to such deposits, are e.g. rare earths and similar metals such as scandium and yttrium, and metals which occur together with these such as niobium, tantalum and uranium. Further, other interesting metals are germanium, indium, vanadium and rhenium. In addition, nickel, cobalt, chromium and other metals may also occur under the conditions as mentioned above.

The problem with valuable metals of the above type is primarily to get them into a suitably concentrated solution from a matrix from which they are difficult to recover. As soon as they have been obtained in a concentrated solution, there are no problems involved in the separation and preparation in pure form, such as e.g. described for rare earths in Revue du Centainaire de l'École Superieure de Physic et Chimie Industrielle (ESPCI, Paris 1982).

From i.a. Report of Investigations 8006 "Lime Roast-Leach Method for Treating Chalcopyrite Concentrate", F. P. Haver and M. M. Wong, Reno Metallurgy Research Center, Reno, Nev. for United Stated Department of the Interior, Bureau of Mines (1975) it is known to roast chalcopyrite together with burnt lime to form insoluble anhydrite so that $SO_2$ is bound and does not escape to the athmosphere.

Norwegian Pat. No. 148.774 describes the use of i.a. sulphur as fuel for reactions which in addition to energy also consumes sulphur oxides, sulphuric acid and/or sulphate.

It has now been found that the problem mentioned initially with the recovery of valuable metals may be solved in a surprising and elegant manner so that deposits which were previously not workable, may be exploited in an economical manner.

According to the invention there is provided a process for the recovery of valuable metals which occur distributed in a calcium carbonate-containing raw material from which they cannot be recovered directly in an economical manner by ore dressing or acid leaching. The process is characterized in that the raw material with the valuable metals is subjected to vigorous heating and is allowed to react with sulphur oxides, particularly $SO_2$, and in that the valuable metals are extracted from the calcine by extraction with dilute acid or water, whereafter the valuable metals are recovered from the extract in a per se known manner.

The heating and the addition of sulphur oxides, particularly $SO_2$, may take place in several ways.

One possibility is to mix the raw material with a sulphurous material to a finely pulverized mixture and then heat this mixture by combustion of the sulphurous material. In the heating calcium carbonate is decomposed to burnt lime and $CO_2$, and in the combustion sulphur oxides are formed, particularly $SO_2$. The $SO_2$ formed will then react directly with CaO formed, to form anhydrite, $CaSO_4$, which is practically insoluble in water and dilute acid. The reactions involved and the total reaction may be illustrated as follows (with pyrite as sulphurous material):

$$2FeS_2+11/2O_2 \rightarrow Fe_2O_3+4SO_2 \quad (1)$$

$$4CaCO_3 \rightarrow 4CaO+4CO_2 \quad (2)$$

$$4SO_2+4CaO+2O_2 \rightarrow 4CaSO_4 \quad (3)$$

$$2FeS_2+4CaCO_3+15/2O_2 \rightarrow Fe_2O_3+4CaSO_4+4CO_2 \quad (4)$$

The heat evolved during the strongly exothermic reaction 1 brings about the decomposition reaction 2, and $SO_2$ from reaction 1 reacts with CaO from reaction 2 to form $CaSO_4$, according to reaction 3 which is also exothermic.

Like $CaSO_4$ the $Fe_2O_3$ formed is also practically insoluble in water and dilute acids. However, the valuable metals, such as those which are mentioned initially, may to a considerable extent be leached out with water or dilute acid, which must be considered as most surprising. It would be expected that the valuable metals were made insoluble at the high temperature, but in contrast thereto it has been found that they primarily remain soluble or are converted to a soluble form.

During the subsequent washing of the calcine with water or dilute mineral acid the valuable metals will accordingly be washed out, while i.a. calcium and iron remain in the calcine. From the aqueous, possibly acidic concentrate the valuable metals may be recovered in a per se known manner, as mentioned above.

Starting materials which contain i.a. the valuable metals and carbonates, usually also contain other substances, such as hematite, $Fe_2O_3$. Hematite is not dissolved by water and dilute acid and remains in the calcine when the latter is washed with water. When pyrite, $FeS_2$, is used in the process, hematite is also formed as mentioned, and the calcine may then optionally be used for the recovery of iron. When choosing a sulphurous mineral for the combustion, there should be selected one which will yield a water- and acid soluble residue in the calcine, unless the sulphurous mineral should contain a metal which is positively desired in the concentrate of the valuable metals. An example of such a sulphurous material is nickel-containing ore, wherein nickel may be desired in the obtained concentrate.

The total reaction between pyrite and carbonatite (reaction 4) is exothermic, viz. such that by roasting 2 moles of pyrite and 4 moles of carbonatite 1684 kcal. are liberated.

The amount of sulphur or sulphurous mineral used in the process should ideally be such that all the calcium carbonate is converted to sulphate. However, it is possible with a minor excess or deficit, e.g. 10%, depending on the specific conditions. If e.g. abundant acid is available for the subsequent leaching of the calcine, a deficit of sulphur or sulphurous mineral may be used, while an excess may be used if the removal of $SO_2$ from exhaust gas does not offer any problem.

A particularly suitable sulphurous mineral is pyrite, particularly because it is relatively cheap and because it upon roasting leads to the formation of hematite which is practically insoluble in water and dilute acid. Other possible minerals are e.g. different types of ore in addition to elementary sulphur.

In reactions 1 and 2 described above gases are evolved, $SO_2$ and $CO_2$ respectively. Ideally all $SO_2$ is trapped and bound as $CaSO_4$, while pure $CO_2$ is allowed to escape or is possibly trapped in a suitable manner.

However, when reactions 1 and 2 and accordingly also 3 take place in the same reactor, some $SO_2$ will escape, particularly initially when reaction 1 necessarily has started before reaction 2. During the process it will be desirable to try to get rid of $CO_2$ in order to accelerate reaction 2, and some $SO_2$ may then easily be carried with. It may therefore be useful to carry out reaction 2 in a separate reactor, which e.g. is heated by means of the heat of reaction from reaction 1. At the start up it may be necessary to use a purification plant to remove $SO_2$, but after reaction 2 has taken place, $SO_2$ may be introduced into the reactor in order for reaction 3 to take place. This may suitably be done by using several reactors in series, so that $SO_2$ from the heating of one reactor is conveyed into the next reactor in which CaO has been formed etc. It is also possible to perform the heating (reaction 2) in another manner, e.g. with electricity or oil, and to introduce $SO_2$ from another source to the reactor which contains the valuable elements together with burnt lime (CaO). $SO_2$ may then e.g. come from a flue gas or roasting gas.

It is also possible, but normally not practical, to mix the raw material and the sulphurous material in a reactor and heat the latter to decompose the carbonate present (reaction 2), whereafter reactions 1 and 3 are initiated in the same reactor.

BRIEF DESCRIPTION OF THE DRAWINGS

Different embodiments are illustrated schematically on the drawings.

Figure 1:
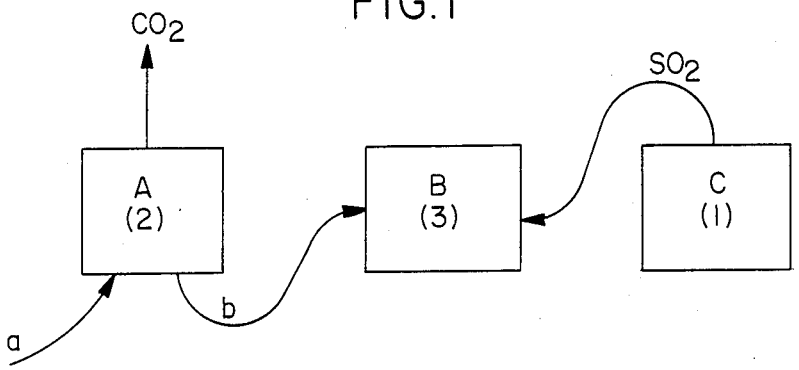
FIG. 1 illustrates the process wherein the raw material (a) is introduced into a reactor (A) in which reaction 2 takes place by heating. The intermediate formed (b) containing i.a. CaO is introduced into another reactor B. Reaction 1 takes place in a third reactor (C), and $SO_2$ from said reactor is introduced into reactor B and is allowed to react with the intermediate from the first reactor (A). $SO_2$ may possibly also come from another source, such as flue gas. The heat evolved in the reactors B and C, may suitably be used for heating of the reactor A in a suitable manner. Possibly further heat is added to the reactor A. The calcine obtained in the reactor B is subjected to washing with water or dilute acid, and the valuable metals are recovered from the aqueous solution obtained thereby. A suitable temperature in reactor A is e.g. about 950° C., in reactor B about 600° C. and in reactor C about 650° C. The temperature in reactor C may be varied in order to adjust the temperature in the other two reactors.
Figure 2:
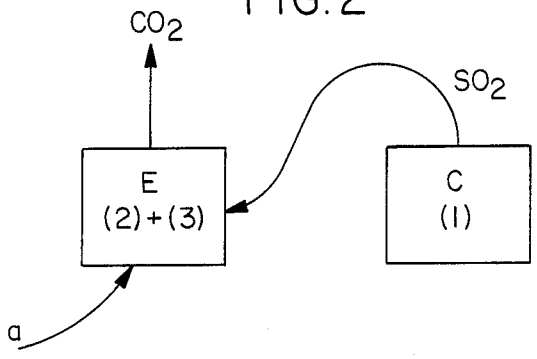
FIG. 2 illustrates the process wherein reaction 1 takes place in a separate reactor (C) as in the process illustrated on FIG. 1. The raw material (a) is charged to another reactor (E) in which both reactions 2 and 3 take place by introducing $SO_2$ from reactor C. Particularly in a continuous process reactions 2 and 3 will normally take place simultaneously, and a suitable temperature will be about 600° C. It is also possible (as mentioned above) to heat the raw material (reaction 2) in reactor E and then mix it with $SO_2$ in the same reactor to bring about reaction 3.
Figure 3:
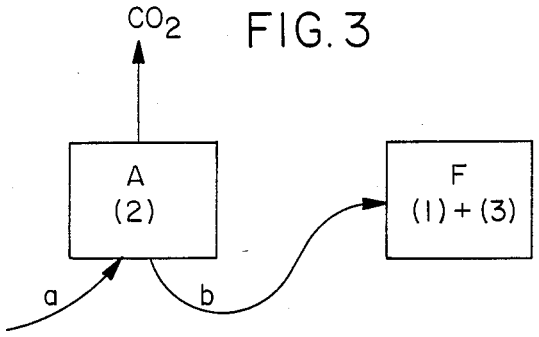
FIG. 3 illustrates the process wherein reaction 2 takes place in a separate reactor (A), and the intermediate containing CaO is charged to another reactor (F) where it is mixed with sulphurous material, and reactions 1 and 3 take place as a sulphatizing roasting.

The recovery of the valuable metals from the calcine obtained in reactors E and F on FIG. 2 and 3 respectively, is carried out as described in connection with FIG. 1.

The combustion of sulphurous material (reaction 1) suitably takes place at e.g. 400–600° C. when pyrite is used, and may take place at somewhat varying temperatures for other materials. The decomposition of carbonate (reaction 2) preferably takes place at a somewhat higher temperature, e.g. 800–900° C., but starts already from about 200° C. The temperature should be at least 400° C. in order for the decomposition to take place sufficiently rapidly and efficiently. A suitable temperature is 950° C. The sulphatization (reaction 3) suitably takes place at 400–650° C., particularly 575–600° C. If two or three reactions take place in the same reactor, the temperatures for the reactions will be the same, and it will generally be necessary to choose a suitable temperature based on the starting materials and the reactor(s).

For the leaching of the calcine, water or particularly dilute mineral acid is used, such as hydrochloric acid or nitric acid, possibly at somewhat elevated temperature, e.g. IOO° C. Suitable acid strength (possibly water) will to a considerable extent be dependent upon the applied temperature.

In experiments carried out with stoichiometric amounts of pyrite and carbonate-containing hematite ore (about 65% $Fe_2O_3$, about 19% Ca-carbonate, about 4% apatite, about 7% silicates and about 4% rare earths), a 20 g pellet after roasting at 600° C. was washed with 600 ml of 2M aqueous HCl. Practically a 100% of the rare earths were found in the obtained extract, but only less than 1% of the original calcium and iron.

I claim:

1. A process for the recovery of rare earths which occur finely distributed in a calcium carbonate-containing raw material, which comprises the steps of:

a. mixing the calcium carbonate-containing raw material containing the rare earths with sulphur or a combustible sulphurous material and subjecting the mixture to combustion, to form a roasted product, b. extracting said rare earths from the roasted product of step a, with dilute acid or water and c. recovering the rare earth from the extract of step b.

2. The process according to claim 1 wherein the calcium carbonate-containing raw material containing the rare earths is mixed with pyrite to form a finely pulverized mixture which is subjected to combustion.

3. The process according to claim 1 wherein the sulphur or the combustible sulphurous material is used in an amount such that essentially all of the carbonate present is decomposed into $CO_2$ and oxide and the oxide is convered to sulphate.

* * * * *